United States Patent [19]

Hill et al.

[11] Patent Number: 4,884,109

[45] Date of Patent: Nov. 28, 1989

[54] DEVICE FOR DEVELOPING ELECTROSTATIC IMAGES

[75] Inventors: Lawrence A. Hill, Rochester; Michael F. Jacobs, Henrietta; Arthur S. Kroll, Brighton; Ralph E. Williams, Rochester, all of N.Y.

[73] Assignee: Eastman Kodak Company, Rochester, N.Y.

[21] Appl. No.: 215,682

[22] Filed: Jul. 6, 1988

[51] Int. Cl.[4] ..... G03G 21/00; G03G 15/06

[52] U.S. Cl. ..... 355/260; 366/292

[58] Field of Search ..... 355/3 DD, 245, 259, 355/260; 118/653, 656, 657, 658; 222/DIG. 1; 366/292

[56] References Cited

U.S. PATENT DOCUMENTS

| | | | |
|---|---|---|---|
| 3,622,054 | 11/1971 | Davidson | 222/DIG. 1 X |
| 4,054,381 | 10/1977 | Bernhard | 355/3 DD X |
| 4,293,085 | 10/1981 | Nakajima et al. | 355/3 DD X |

*Primary Examiner*—A. T. Grimley
*Assistant Examiner*—Barry J. Shapiro
*Attorney, Agent, or Firm*—Leonard W. Treash

[57] ABSTRACT

A device for developing electrostatic images includes a toner supply chamber for holding a supply of dry toner and a feed member located generally at the bottom of the supply chamber. To break up agglomeration of toner in the supply chamber an agitator, for example an elongated polypropylene fiber brush, is placed on top of the feed member and is supported totally at its periphery by the feed member and associated walls of the supply chamber. As the feed member rotates, the agitator is rotated to maintain the toner in particulate form.

2 Claims, 1 Drawing Sheet

FIG. 1
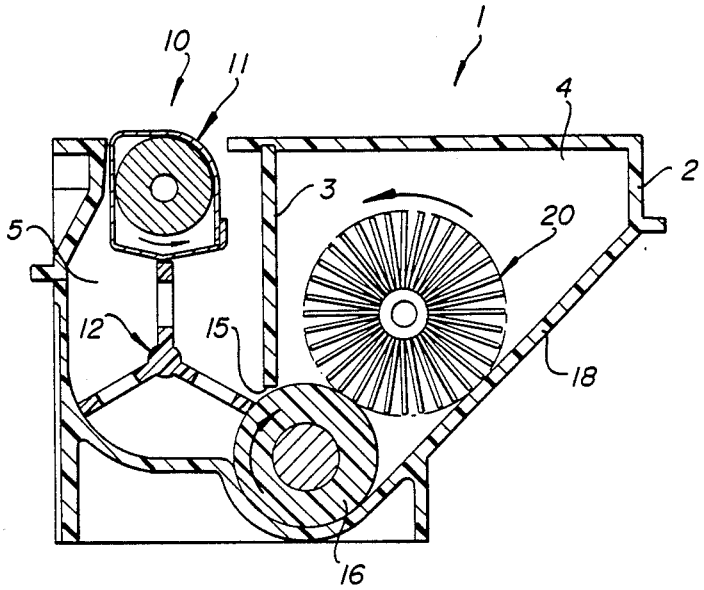
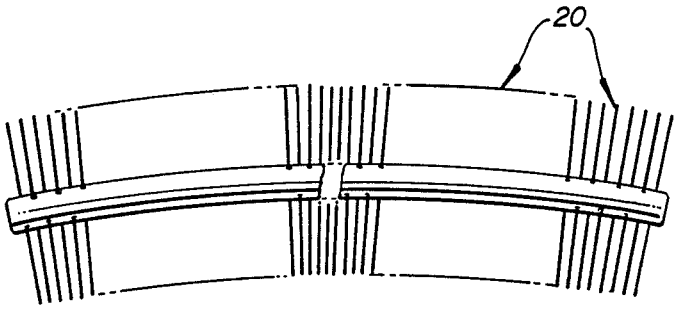
FIG. 2

DEVICE FOR DEVELOPING ELECTROSTATIC IMAGES

TECHNICAL FIELD

This invention relates to a device for developing electrostatic images, and more specifically, to an agitator for preventing agglomeration and improving flow in a toner supply chamber of such a device.

BACKGROUND ART

U.S. patent application Nos. 116,200 and 116,294, both filed by L. A. Hill and M. E. Jacobs, Nov. 3, 1987 and entitled "Disposable Development Station Having Means for Assisting in the Feeding of the Toner Supply and Preventing Replenishment of the Toner Supply" and "Disposable Development Station for Low Cost Copier or Printer" disclose a disposable device for developing electrostatic images. The device includes a housing divided into two chambers by a center wall. One chamber is a supply chamber for holding a supply of dry toner. The other chamber is a development chamber for mixng the toner with a carrier and applying it to a moving electrostatic image. The center wall has an opening in its bottom to provide access between the two chambers. A feed member is located generally in the opening and is rotatable to transport toner from the supply chamber to the development chamber. One wall of the supply chamber is slanted to urge toner to the feed member under the force of gravity.

Unfortunately, toner does not readily stay in its finely divided particulate shape. It has a tendency to agglomerate and cake, especially in certain conditions of temperature and humidity. If the device is disposable, it is also the storing container for the toner prior to use in a machine, a fact which greatly contributes to the tendency of the toner to cake.

In the structure described in the aforesaid application, toner is urged against the feed member by the addition of a hinged plate which is placed on top of the toner after it has been loaded into the toner supply chamber. The plate urges the toner against the feed member and increases the continuity of the toner fed to the development chamber to a certain extent. However, some caking and agglomeration persist, despite the plate.

DISCLOSURE OF THE INVENTION

It is the object of the invention to provide a device for developing electrostatic images generally of the type described, but with less agglomeration and caking of toner in the toner supply chamber.

It is another ojbect of the invention that such mixing be accomplished by a structure which is sufficiently inexpensive that it is disposable.

These and other objects are accomplished by a device for developing electrostatic images substantially as described but with an agitaor located in the supply chamber, which agitator is rotatable by peripheral engagement with the feed member.

According to a preferred embodiment, the mixing member is a rotatable fiber brush supported soley be peripheral engagement with the feed member and a slanted wall partially defining the chamber. With such a structure, the brush can be made of an extremely inexpensive material such as polypropylene and can be assembled by merely placing it in the chamber in the appropriate position without need for axial mounting.

According to a further preferred embodiment, the feed member has an outer portion which is soft, for example, is made of a foam material, which material facilitates its feeding of toner into the development chamber and also increases the engagement with the rotating brush to facilitate rotation of it.

BRIEF DESCRIPTION OF THE DRAWING

FIG. 1 is a cross-section of a device for developing electrostatic images constructed according to the invention.

FIG. 2 is a side view of an agitator constructed according to one embodiment of the invention.

BEST MODE OF CARRYING OUT THE INVENTION

According to FIG. 1, a device 1 for developing electrostatic images includes a housing 2. The housing has external walls and a center wall 3 which divides the device into a supply chamber 4 and a development chamber 5. The development chamber 5 includes a development opening 10 in which is located a magnetic brush 11. Below the magnetic brush in the development chamber 5 is a mixing member 12. The center wall 3 has a toner supply opening 15 at its bottom, in which is generally located a feed member 16. The magnetic brush 11, mixing member 12 and feed member 16 are rotatable at different speeds by independent drives, not shown.

In operation, feed member 16 is rotatable to transport toner from the toner supply chamber 4 into the development chamber 5. Once toner is in the development chamber, it is mixed with carrier particles by rotation of mixing member 12 which also presents the mixture to the magnetic brush 11. The magnetic brush 11 moves the mixture clockwise as shown into development relation with an electrostatic image which is moved through a development zone associated with development opening 10, and the image is developed according to a technology well understood in the art.

Unfortunately, the toner is made of material which has a tendency to cake or agglomerate over time, especially when subjected to certain humidity and temperature conditions. An outer wall 18 is slanted to urge the toner into contact with feed member 16 under the force of gravity. However, even with this construction, if the toner is left in the supply chamber for a substantial period of time in a high temperature, high humidity environment, it does not readily slide into engagement with the feed member 16.

In this particular device, toner has a tendency to stay in the upper right portion of the supply chamber 4 as shown in FIG. 1. Development devices are disposed of prior to their being empty.

Even toner that reaches the feed member can stay in agglomerated form to some extent when it passes into the development chamber 5. This problem can cause a reduction in toner concentration in the development chamber and insufficient development of electrostatic images as well as chunks of toner that do not get thoroughly mixed with carrier in the development chamber and therefore are not properly charged for the development process.

To solve this problem, an agitator 20 is located in the development chamber. It is supported peripherally by feed member 16 and slanted outer wall 18.

Preferably, the agitator 20 is an elongated cylindrical brush which can be made out of an inexpensive material such as polypropylene, and, in assembly, is merely placed in toner supply chamber 4 prior to loading developer into the chamber. It is not axially supported and therefore requires no mounting whatsoever. Its periphery rests on feed member 16 and slanted wall 18. As feed member 16 rotates to transport toner into development chamber 5, it rotates agitator 20 thereby thoroughly agitating and breaking up the toner in the supply chamber 4. Feed member 16, being made of a soft foam, is compressed substantially by the fibers in the agitator 20 which provides excellent engagement for rotation of agitator 20 despite the resistance of the surrounding toner.

Agitator 20 rotation against slanted wall 18 is not totally regular, causing vibration of wall 18 which shakes loose toner caked in the upper right portion of chamber 4. This action can be accentuated by bending agitator 20 lengthwise to a curved or other irregular shape, as shown in FIG. 2. With this embodiment, engagement with both slanted wall 18 and feed member 15 alternates from the center to the ends of agitator 20, providing wall 18 with a mechanical impact once each revolution. This mechanical impact loosens toner in the upper right portion of the chamber, from where it falls to the drive member 16.

With this invention, the developing device can be made disposable permitting it to be stored for substantial lengths of time with toner in the supply chamber. When the developing device is placed in the machine and feed member 16 is rotated, the resulting rotation of agitator 20 and the vibration of wall 18 break up any agglomerated or caked toner and facilitate its feeding to development chamber 5.

Agitator 20, itself, is extremely inexpensive and its assembly cost is negligible.

While the invention has been described in connection with a preferred embodiment thereof, it will be understood that variations and modifications can be effected within the spirit and scope of the invention as described hereinabove and as defined in the appended claims.

We claim:

1. A device for developing electrostatic images including a housing defining a chamber for holding a supply of finely divided, dry, particulate toner, a feed member located generally at the bottom of the chamber which feed member is rotatable to transport toner out of said chamber into another portion of the device where the toner is used to develop electrostatic images, said chamber being defined by walls shaped to urge toner to said feed member under the force of gravity, characterized by an agitator located in said chamber and rotatable by peripheral engagement with said feed member said agitator having an end to end curvature sufficient to cause a periodic impact with a wall of the chamber to dislodge toner.

2. A device for developing electrostatic images including a housing defining a chamber for holding a supply of finely divided, dry particulate toner, a feed member located generally at the bottom of the chamber which feed member is rotatable to meter toner out of said chamber into another portion of the device where the toner is used to develop elecrostatic images, said chamber being defined by at least one wall that is slanted to urge toner to said feed member under the force of gravity, characterized by an elongated agitating brush located in said chamber, supported by peripheral engagement with said slanted wall and said feed member and rotatable by such peripheral engagement with said feed member said brush being sufficiently curved, end to end, to periodically impact said slanted wall, as said brush is rotated, to dislodge toner.

* * * * *